US005811709A

United States Patent [19]

Adinolfi

[11] Patent Number: 5,811,709

[45] Date of Patent: Sep. 22, 1998

[54] ACOUSTIC DRUM WITH ELECTRONIC TRIGGER SENSOR

[76] Inventor: Alfonso M. Adinolfi, 607-18th Ave. East, Seattle, Wash. 98112

[21] Appl. No.: 925,414

[22] Filed: Sep. 8, 1997

[51] Int. Cl.[6] ..... C10D 13/02; G10H 3/00

[52] U.S. Cl. ..... 84/723; 84/724; 84/725; 84/730; 84/DIG. 24

[58] Field of Search ..... 84/723–725, 730, 84/738, DIG. 24, 411 R

[56] References Cited

U.S. PATENT DOCUMENTS

| | | | |
|---|---|---|---|
| 3,725,561 | 4/1973 | Paul . | |
| 4,226,156 | 10/1980 | Hyakutake | 84/114 |
| 4,279,188 | 7/1981 | Scott | 84/1.14 |
| 4,581,973 | 4/1986 | Hoshino | 84/1.14 |
| 4,899,633 | 2/1990 | Lombardi | 84/730 |
| 4,947,725 | 8/1990 | Nomura | 84/723 |
| 4,984,498 | 1/1991 | Fishman | 84/730 |
| 5,105,710 | 4/1992 | Rothmel | 84/730 |
| 5,293,000 | 3/1994 | Adinolfi | 84/730 |

*Primary Examiner*—William M. Shoop, Jr.
*Assistant Examiner*—Marlon Fletcher
*Attorney, Agent, or Firm*—Graybeal Jackson Haley LLP

[57] ABSTRACT

An acoustic drum capable of triggering an electronic sound source is provided by a combination of a drum body shell, conventional drum heads held at adjustable tension across open ends of the shell, and a sound-to-electrical transducer mounted within an open space of the interior or exterior shell wall surface. The sound-to-electrical transducer is connected to an audio jack assembly which in turn allows the drum to be connected to conventional downstream electronics. The sound energy attenuating characteristics of the mounting material and the surrounding shell wall prevent the transducer from being falsely triggered by ambient sound exterior to the drum, by sympathetic vibrations of the drum, and resists false triggering due to lightly, inadvertently hitting the drum stand.

47 Claims, 2 Drawing Sheets

ACOUSTIC DRUM WITH ELECTRONIC TRIGGER SENSOR

FIELD OF THE INVENTION

The invention relates to percussion musical instruments and in particular to a new acoustic drum with an embedded sensor capable of triggering an electronic device.

BACKGROUND OF INVENTION

Following the success of electric keyboards and guitars, innovators have created the electronic counterparts of other acoustic instruments, including drums.

In providing the electronic counterpart of acoustical drums, small circular resilient pads are often used to convert the strike of the player's drumsticks into electronic impulses that are in turn converted into synthesized drumlike sounds. These electronic drum pads represent one kind of electronic percussion instrument for creating the synthesized drum sounds. Drum pads are typically made with stretched skin backed by a light density foam material over a transducer sound board. An example of the electronic drum pad is found in U.S. Pat. No. 4,947,725. While electronic pads of this kind have enjoyed a following among musicians and audio engineers, the pads have not been able to provide the same feel and texture as the drum heads of the acoustic snare, tom and bass.

While electronic percussion instruments have the advantage of controlled output and the ability to produce a wide variety of sounds, they do not play the same as an acoustic drum. There is a definite disadvantage to the drummer in that the look, feel, and response of most electronic drums fail to give the player anything remotely similar to the response rhythm that a traditional acoustic drum provides. Since drummers acquire their technical ability from acoustic drums, the changeover to electronic pads may be unacceptable to some performers and less than optimum for others. The disadvantages are primarily in the feel of the sticks as they strike the simulated drum surface and, in the drummer's motor memory in reaching for the usual placement and strike area of conventional acoustic sets.

In order to try and solve the problems associated with the feel of electric drums innovators have tried to use acoustic drums in place of the electronic pads as the triggering mechanism for a drum synthesizer. Generally, these devices use a transducer mounted on the acoustic drum in order to detect the impact of the drumstick on the drum head. There are three basic methods for mounting transducers on acoustic drums: air coupling including internal mounting, head mounting, and shell mounting.

Air coupling uses a transducer, typically a microphone, placed in close proximity to the drum head to detect air movement produced by the vibrating drum head. Because the transducer cannot readily discriminate the source of the air vibration, external air coupling is highly susceptible to background noise and produces a high percentage of false triggers. While internal mounting of the microphone within the internal cavity of the drum shell reduces the instances of false triggers it requires extensive modification to the drum and significantly alters the acoustic properties of the drum. Even in drums which use internal mounting for air coupling there is a high incidence of false triggering. Another disadvantage to air coupling is that attached transducers tend to mechanically unreliable and typically require a separate power source.

Head mounting uses a transducer, typically a piezoelectric element, glued or taped to the drum head to directly detect the vibration of the drum head. This method of mounting a transducer also suffers from a high incidence of false triggering because of the long duration for which the drum head continues to vibrate after it is initially struck. An acoustic drum head will vibrate much longer after it is struck than the pads typically used in electronic drums. Another disadvantage is that the acoustics of the drum are corrupted by mounting a transducer on the drum head. Additionally, head mounted transducers are inherently unreliable because the adhesives used are often unable to withstand the constant vibration of the drum head and eventually fall off.

Shell mounting uses a transducer, typically a piezoelectric element, screwed or glued to the inside or outside of the drum shell. While mechanically more reliable than air coupling or head mounting, shell mounting still suffers from an inability to discriminate between individual drumstick strikes on the drum head and background noise. Depending upon how and where the transducer is mounted, this method may also result in a degradation of the acoustic properties of the drum.

All three of these mounting methods share the disadvantages of being susceptible to false triggering, varying degrees of mechanical unreliability, and possible corruption of the acoustic characteristics of the drum. The most significant of these shortcomings is the problem of false triggering from background noise or retriggering caused by the long duration of the drum head vibration caused by a drumstick strike. This problem is typically overcome by setting the sensitivity threshold level where only the hardest strikes are registered by the drum synthesizer. While this may reduce the number false triggers and retriggers it severely limits the range of drumstick strikes which the synthesizer will register. This in turn will require the drummer to increase the force with which they strike the head in order to guarantee the strike registering.

Alternatively the drum may be dampened in order to increase the range of strikes the synthesizer will register, but this method effectively eliminates the acoustic functionality of the drum. An example of a dampened drum with an electronic sensor is found in U.S. Pat. No. 5,593,000.

SUMMARY OF THE INVENTION

There is demand for a drum which may be used as either an electric or acoustic instrument with the ability to change function on demand. There is a further demand for a fully functional acoustic drum with the ability to simultaneously trigger an electronic sound source without false triggering. There still a further demand for an acoustic drum with the ability to simultaneously trigger an electronic sound source which does not require batteries or a phantom power source to make the drum work.

Thus, in accordance with the preferred embodiment of the invention, a fully functional acoustic drum with the ability to simultaneously trigger an electronic sound source while remaining highly resistant to false triggering is provided by the combination of a drum body shell having an opening for receiving thereacross a drum head, preferably under tension, and forming therewithin a drum cavity. An open space, typically a recess formed by routing, is provided within the interior or exterior surface of the drum shell and provides a unique location in which a sound-to-electrical trigger transducer is mounted. The location and configuration of the recess is based upon the dimensions of the drum, the drum shell material, and the type of sound-to-electrical trigger transducer being employed. The sound-to-electrical trigger transducer is mounted in the recess by means of a hardening adhesive material. The transducer is selected and the recess is sized and located such that when the transducer is mounted only a direct striking of the drumhead or shell will produce a triggering electrical signal. The recess and transducer mounted therein are sized and placed such that the transducer will not produce a triggering electrical signal in response to ambient background noise.

The components and operation of the inventive drum provides an easily manufactured, readily reparable, reliable musical system that combines the advantage of having an acoustic drum with the ability of being able to control an electronic sound source. The invention is applicable to standard types and sizes of drums, including snare, bass and tom, as well as custom sizes.

These and further features, objects and advantages of the invention will become apparent to those skilled in the art from the following detailed description and dependent drawings.

DETAILED DESCRIPTION OF THE INVENTION

Figure 1:
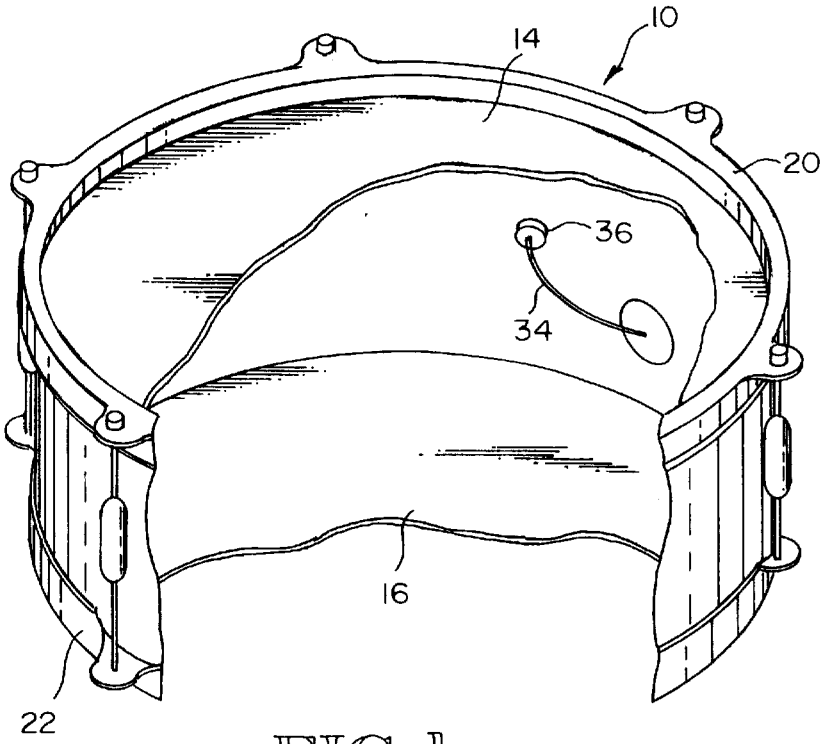
FIG. 1 is a cutaway perspective view of one embodiment of the present invention showing the external appearance of a tom drum body, the striking head of a tom drum and the internal placement of the sound-to-electrical trigger transducer.

In a preferred embodiment of a snare and tom drum, the electronic percussion system of the present invention is implemented as shown in FIGS. 1–4 to have the external appearance of a conventional acoustic drum 10 but incorporating within the drum shell 12 a recess 30 into which is mounted a sound-to-electrical trigger transducer 32. Typically, a piezoelectric element is used for trigger transducer 32 which is uniquely arranged to selectively, electronically respond to direct striking of the drum head or shell while remaining electronically quiet without false triggering in the presence of other sources of sound energy and sympathetic vibrations. The system is resistant to triggering when stand and other accessories are inadvertently lightly hit. The drum should and does trigger when struck on the rim 20 and 22, shell 12 or lugs 28. The sound energy attenuating characteristics of the hardening adhesive material and the surrounding shell wall prevent the transducer from being falsely triggered by ambient sound exterior to the drum, by sympathetic vibrations of the drum, and resists false triggering due to lightly, inadvertently hitting the drum stand.

Figure 3:
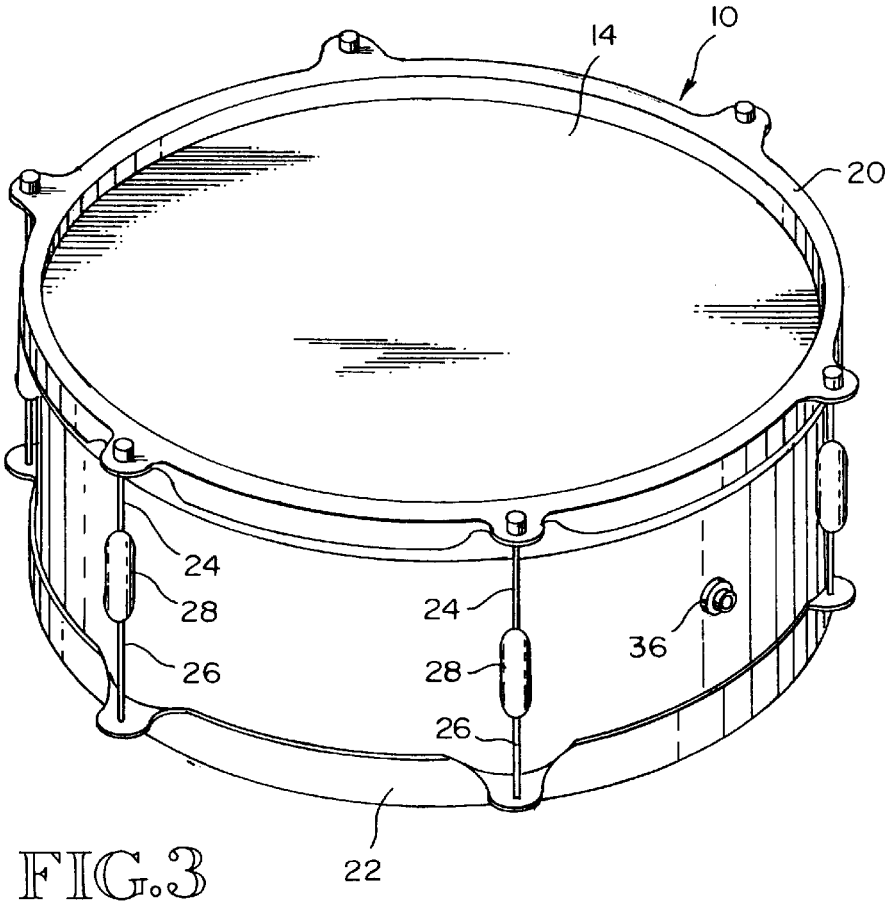
FIG. 3 is a perspective view of one embodiment of the present invention showing the external appearance of a tom drum body and striking head of a tom drum.
Figure 4:
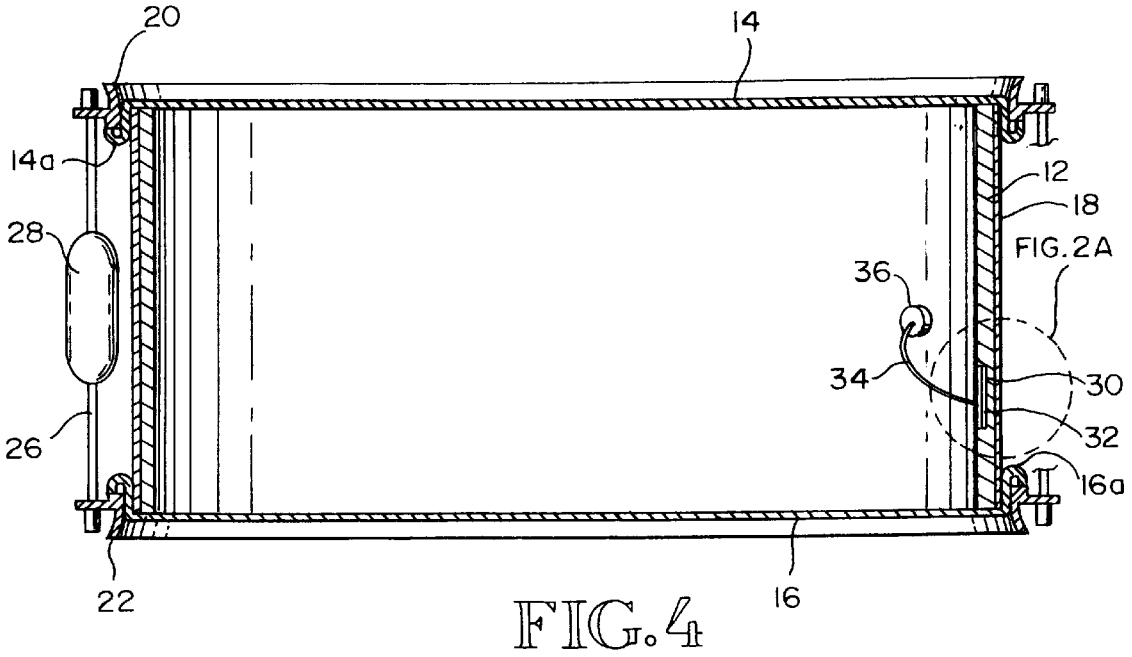
FIG. 4 is a vertical section through the diameter of the tom drum illustrated in FIG. 3

The snare, bass, and tom configurations are essentially the same and are represented by the internal construction of tom drum 10 shown in FIGS. 1–4 and described as follows. The drum frame or body is a hollow wooden cylindrical shell 12, to which a striking drum head 14 and an opposed lower drum head 16 are disposed across the open axial ends of the cylindrical shell 12. A decorative, relatively thin plastic or other material wrap 18 may be provided about the outer circumferential wall of shell 12. To further absorb and/or dissipate sound energy that otherwise might cause false triggering, the body shell 12 is a 6-ply veneer hardwood which has proven to work better than metal or plastic shells. Shells constructed from maple, birch or mahogany are preferred and may have a variable number of ply (5–10 ply is typical). As shown in FIGS. 3 and 4, and the entire assembly is held in place by conventional head hoops or rims 20 and 22 and circumferentially spaced pairs of inline tensioning screws 26 and cooperating retaining lugs 28. The striking head 14 and bottom head 16 each have a circumferential edge bead 14*a* and 16*a*, respectively, which is engaged by a shoulder of tensioning rims 20 and 22, respectively, to stretch heads 14 and 16 across the axial end openings of shell 12 to a desired tension control by adjusting screws 24 and 26 in the same manner as an acoustical drum is tuned. The drum heads 14 and 16 are conventional acoustic heads of synthetic flexible sheet material or animal skins.

Unlike a traditional acoustical drum, refer to FIGS. 1 and 4, the interior cavity formed by the inner circumferential wall of shell 12 and the spaced parallel inner surfaces of striking head 14 and bottom head 16 is provided with a recess 30 into which is mounted a sound-to-electrical trigger transducer 32. In the preferred embodiment the recess 30 is formed by routing out an open space having a diameter larger than the selected sound-to-electrical trigger transducer 32. The depth of the recess is dependent upon the dimensions of the drum, the shell material, and the type of transducer being used.

The transducer 32 itself is a piezoelectric assembly and consists of a piezoelectric element mounted on a somewhat larger diameter metal disk and having leads 34*a* and 34*b* soldered or brazed to the transducer components. More particularly, the piezoelectric transducer used in this embodiment has the following manufacturer specifications: element thickness 0.53 mm; metal thickness 0.25 mm; electrode diameter 23.5 mm; impedance 200 ohms; and frequency 2.8 kHz–0.5 kHz. Other commercially available sensors, including various piezoelectric transducers, may be used for the sound-to-electrical trigger transducer 32. Extending from transducer 32, leads 34*a* and 34*b*, which may be individual wires or a section of coaxial cable, connect to the terminals of a standard ¼" audio jack assembly 36 mounted on shell 12 and passing through the shell 12 and the plastic cosmetic wrap 18 as illustrated in FIG. 4.

Figure 2A:
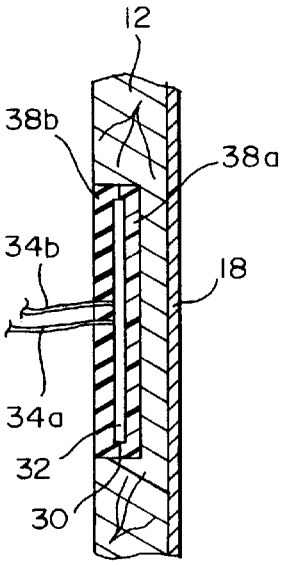
FIG. 2*a* is an enlarged sectional view illustrating the sound-to-electrical trigger transducer mounted within a recess in the drum shell sandwiched between two layers of hardening adhesive material.
Figure 2B:
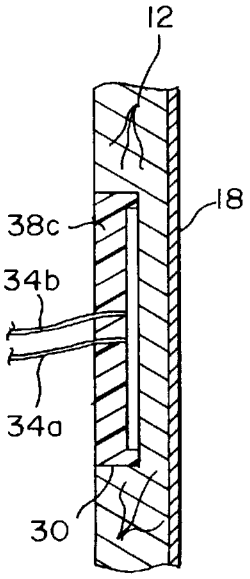
FIG. 2*b* is an enlarged sectional view illustrating the sound-to-electrical trigger transducer mounted within a recess in the drum shell with a layer of hardening adhesive material deposited on top of the sound-to-electrical trigger transducer.

To mount transducer 32 within recess 30, refer to FIGS. 2A and 2B, it is preferred that a hardening adhesive material 38 be used to permanently mount the transducer 32 within recess 30. In the preferred embodiment the hardening adhesive material 38 is comprised of silicone and epoxy resin. Other commercially available mounting materials may be used.

FIG. 2A illustrates the preferred mounting method, wherein the transducer 32 is sandwiched between two layers of hardening adhesive material 38*a* and 38*b* within recess 30. In the preferred embodiment hardening adhesive material 38*a* is an epoxy resin which is first deposited into the recess 30. Then the transducer 32 is mounted in the epoxy layer of hardening adhesive material 38*a*. A second layer of hardening adhesive material 38*b* is then deposited on top of the transducer 32 so as to fill the remaining volume of the open space or recess 30. In the preferred embodiment the second layer of hardening adhesive material 38*b* is silicone.

FIG. 2B shows an alternative mounting method wherein the transducer is placed within the recess and then a single layer of hardening adhesive material 38*c* is deposited over top of the transducer 32 thereby filling the remaining volume of recess 30. In this embodiment the hardening adhesive material 38*c* is either silicone, epoxy resin, or a combination of the two materials.

FIGS. 1–4 illustrate a recess that has been formed from the interior surface of the drum shell 12. However, it is well within the scope of the invention to include open spaces that have been formed from the exterior surface of the drum shell 12. In the case where the open space or recess 30 is formed from the exterior of the drum shell surface the electrical leads 34*a* and 34*b* may either be passed through an opening in the shell wall surface to the interior cavity in order to be connected to audio jack assembly 36. Alternatively, electrical leads 34*a* and 34*b* may pass along the surface of drum shell 12 to be connected to audio jack assembly 36. Outer wrap 18 may be used to both protect and cover leads 34*a* and 34*b*.

From jack 36, the electrical signals produced by transducer 32 in response to striking drum head 14 are fed to conventional downstream electronics.

While only particular embodiments have been disclosed herein, it will be readily apparent to persons skilled in the art that numerous changes and modifications can be made thereto, including the use of equivalent means, devices and methods, without departing from the spirit of the invention.

I claim:

1. percussion instrument comprising:

a) an open ended drum body shell having an interior surface and an exterior surface;

b) a striking drum head mounted across an open end of said shell; and c) a sound-to-electrical trigger transducer mounted in an open space formed in said drum body shell.

2. The percussion instrument of claim 1, wherein said sound-to-electrical transducer is placed at a spacing from said open end such that said sound-to-electrical transducer will produce an electrical trigger signal when said drum head is struck and will not produce such an electrical signal when subjected to external sound.

3. The percussion instrument of claim 2, wherein said sound-to-electrical transducer is and secured with an adhesive material.

4. The percussion instrument of claim 3, wherein said open space is a recess formed in the interior surface of said drum body shell.

5. The percussion instrument of claim 2, wherein said drum body shell is comprised of multiple ply and said sound-to-electrical transducer is embedded between the ply of said drum body shell.

6. A percussion instrument comprising:

a) a cylindrical drum body shell having an interior wall surface, an exterior wall surface, a first end and a second end; wherein an open space for mounting a transducer is formed in said body shell;

b) a striking drum head mounted across said first open end; and c) a sound-to-electrical trigger transducer mounted within said open space.

7. The percussion instrument of claim 6, wherein said open space and transducer therein are positioned within said interior wall surface intermediate said first and second ends and placed such that said sound-to-electrical transducer will produce a trigger electrical signal when said drum head is struck and will not produce such a trigger electrical signal when subjected to external ambient sound.

8. The percussion instrument of claim 7, wherein said open space is a recess and said sound-to-electrical transducer is permanently secured within said recess by means of an adhesive material.

9. The percussion instrument of claim 8, wherein said sound-to-electrical transducer is mounted within said recess and a layer of said adhesive material is deposited on top of said sound-to-electrical transducer.

10. The percussion instrument of claim 8, wherein said sound-to-electrical transducer is sandwiched between a first layer of said adhesive material deposited within said recess and a second layer of adhesive material deposited on top of said sound-to-electrical transducer.

11. The percussion instrument of claim 8, wherein said adhesive material is comprised of silicone and epoxy resin.

12. The percussion instrument of claim 9, wherein said adhesive material is comprised of silicone and epoxy resin.

13. The percussion instrument of claim 10, wherein said adhesive material is comprised of silicone and epoxy resin.

14. The percussion instrument of claim 10, wherein said first layer of adhesive material is comprised of epoxy and said second layer of adhesive material is comprised of silicone.

15. The percussion instrument of claim 11, wherein said sound-to-electrical transducer is a piezoelectric element.

16. The percussion instrument of claim 12, wherein said sound-to-electrical transducer is a piezoelectric element.

17. The percussion instrument of claim 10, wherein said sound-to-electrical transducer is a piezoelectric element.

18. The percussion instrument of claim 8, further comprising an outer wrap about the outer circumferential wall of said drum shell.

19. The percussion instrument of claim 18, wherein said outer wrap is a plastic material.

20. The percussion instrument of claim 6, wherein said open space and transducer therein are positioned intermediate said first and second ends within said exterior wall surface and placed such that said sound-to-electrical transducer will produce a trigger electrical signal when said drum head is struck and will not produce such a trigger electrical signal when subjected to external ambient sound.

21. The percussion instrument of claim 20, wherein said open space is a recess and said sound-to-electrical transducer is permanently mounted within said recess by means of an adhesive material.

22. The percussion instrument of claim 21, wherein said sound-to-electrical transducer is mounted within said recess and a layer of said adhesive material is deposited on top of said sound-to-electrical transducer.

23. The percussion instrument of claim 21, wherein said sound-to-electrical transducer is sandwiched between a first layer of said adhesive material deposited within said recess and a second layer of adhesive material deposited on top of said sound-to-electrical transducer.

24. The percussion instrument of claim 21, wherein said hardening adhesive material is comprised of silicone and epoxy resin.

25. The percussion instrument of claim 22, wherein said adhesive material is comprised of silicone and epoxy resin.

26. The percussion instrument of claim 23, wherein said adhesive material is comprised of silicone and epoxy resin.

27. The percussion instrument of claim 23, wherein said first layer of adhesive material is comprised of epoxy and said second layer of adhesive material is comprised of silicone.

28. The percussion instrument of claim 24, wherein said sound-to-electrical transducer is a piezoelectric element.

29. The percussion instrument of claim 25, wherein said sound-to-electrical transducer is a piezoelectric element.

30. The percussion instrument of claim 26, wherein said sound-to-electrical transducer is a piezoelectric element.

31. The percussion instrument of claim 21, further comprising an outer wrap about the outer circumferential wall of said drum shell.

32. The percussion instrument of claim 31, wherein said outer wrap is a plastic material.

33. A method for manufacturing a percussion instrument comprising the steps:

a) forming a recess in a cylindrical drum body shell having an interior surface, an exterior surface, a first open end and a second open end;

b) permanently mounting a sound-to-electrical transducer within said recess; and c) mounting a striking drum head across said first open end.

34. The method of claim 33, wherein said recess is formed in the interior surface of said drum shell.

35. The method of claim 34, wherein an adhesive material is used to mount said sound-to-electrical transducer within said recess.

36. The method of claim 35, wherein said sound-to-electrical transducer is mounted within said recess and a layer of said adhesive material is deposited on top of said sound-to-electrical transducer.

37. The method of claim 35, wherein said sound-to-electrical transducer is sandwiched between a first layer of said adhesive material deposited within said recess and a second layer of hardening adhesive material deposited on top of said sound-to-electrical transducer.

38. The method of claim 37, wherein said first layer of adhesive material is comprised of epoxy and said second layer of adhesive material is comprised of silicone.

39. The method of claim 34, further comprising the step of mounting an outer wrap about the outer circumferential wall of said drum shell.

40. The method of claim 39, wherein said outer wrap is a plastic material.

41. The method of claim 33, wherein said recess is formed in the exterior surface of said drum shell.

42. The method of claim 41, wherein an adhesive material is used to mount said sound-to-electrical transducer within said recess.

43. The method of claim 42, wherein said sound-to-electrical transducer is mounted within said recess and a layer of said adhesive material is deposited on top of said sound-to-electrical transducer.

44. The method of claim 42, wherein said sound-to-electrical transducer is sandwiched between a first layer of said adhesive material deposited within said recess and a second layer of adhesive material deposited on top of said sound-to-electrical transducer.

45. The method of claim 44, wherein said first layer of adhesive material is comprised of epoxy and said second layer of adhesive material is comprised of silicone.

46. The method of claim 42, further comprising the step of mounting an outer wrap about the outer circumferential wall of said drum shell.

47. The method of claim 46, wherein said outer wrap is a plastic material.

* * * * *